United States Patent [19]

Kralowetz et al.

[11] 4,157,026

[45] Jun. 5, 1979

[54] SWAGING MACHINE FOR SWAGING LARGE TUBES

[75] Inventors: Bruno Kralowetz; Hans Hojas; Johann Braunwieser, all of Steyr, Austria

[73] Assignee: GFM Gesellschaft fur Fertigungstechnik und Maschinenbau Aktiengesellschaft, Steyr, Austria

[21] Appl. No.: 888,411

[22] Filed: Mar. 20, 1978

[30] Foreign Application Priority Data

Apr. 1, 1977 [AT] Austria ..... 2272/77

[51] Int. Cl.[2] ..... B21J 7/18; B21D 43/00

[52] U.S. Cl. ..... 72/401; 72/419

[58] Field of Search ..... 72/402, 401, 189, 419, 72/9, 10, 370

[56] References Cited

U.S. PATENT DOCUMENTS

| | | | |
|---|---|---|---|
| 2,114,302 | 4/1938 | Harter | 72/419 |
| 3,177,688 | 4/1965 | Kralowetz | 72/401 |
| 3,817,070 | 6/1974 | Ribback | 72/402 |

FOREIGN PATENT DOCUMENTS

| | | | |
|---|---|---|---|
| 625116 | 8/1961 | Canada | 72/419 |

*Primary Examiner*—C. W. Lanham

*Assistant Examiner*—Gene P. Crosby

*Attorney, Agent, or Firm*—Kurt Kelman

[57] ABSTRACT

First and second gripping heads consisting of a manipulator and a holder-up, respectively, are disposed on opposite sides of a swaging box. First and second sleeves are rotatably mounted in said first and second gripping heads, respectively and aligned on a horizontal axis which extends through said swaging box. A mandrel is non-rotatably and axially immovably mounted in said first sleeve and adapted to carry a tubular workpiece surrounding said mandrel. First and second abutments are carried by said first and second gripping sleeves, respectively, and have first and second annular gripping surfaces, respectively. Axial drive means serve to move said first gripping head along said horizontal axis toward said swaging box and to simultaneously move said second gripping head in the same direction. Control means serve to sense the magnitude of said gripping force exerted by said abutments with said first and second annular gripping surfaces and to detect any deviation of said magnitude from a set value and for controlling the movement of said second gripping head relative to said first gripping head along said horizontal axis in dependence on such deviation as said first and second gripping heads are simultaneously moved along said horizontal axis in said direction.

11 Claims, 5 Drawing Figures

SWAGING MACHINE FOR SWAGING LARGE TUBES

Figure 1:
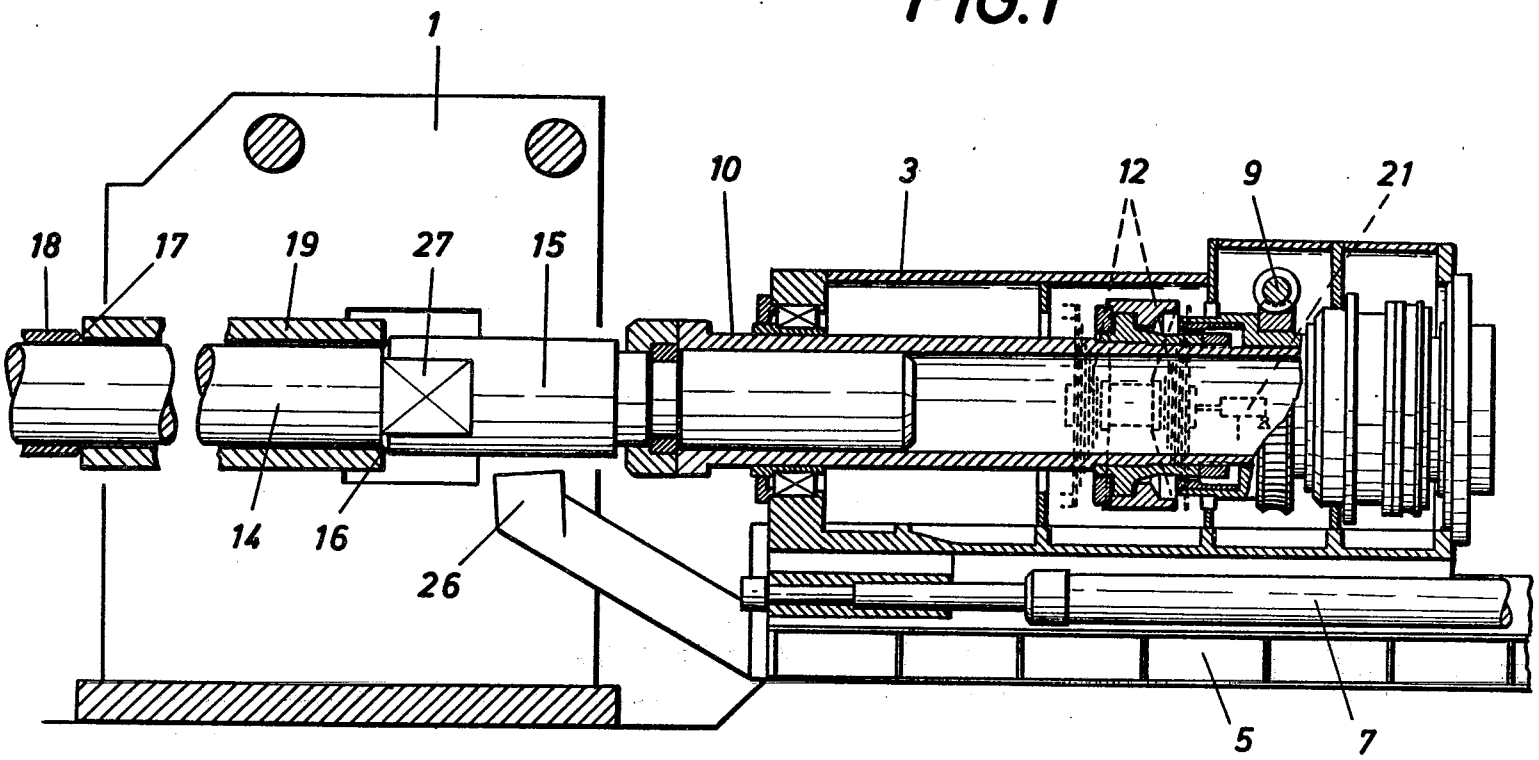

This invention relates to a swaging machine for swaging large tubes on a long mandrel, comprising two horizontally displaceable gripping heads, which are disposed on opposite sides of a swaging box, and two sleeves, which extend in the workpiece-feeding direction through respective ones of said gripping heads and are adapted to receive the mandrel and are rotatable and adapted to be driven.

In the previously known swaging machines for hot-swaging large tubes, i.e., tubes which are larger than 200 mm in diameter, on a long mandrel, an expensive manipulator is required at least on one side of the swaging box to carry not only the mandrel but also gripping jaws for holding the workpiece. These manipulators involve an extremely high expenditure and the gripping jaws contact large surfaces of the workpiece so that the latter is substantially cooled and only one pass can be performed per heat where these manipulators are employed. On the other hand, the swaging of such tubes cannot be completed in one pass so that the swaging of large tubes with the known swaging machines is very time-consuming and complicated. Difficulties are also involved in the withdrawal of the finished tube from the mandrel.

It is an object of the invention to eliminate these disadvantages and to provide a swaging machine which is of the kind described first hereinbefore and which is as simple as possible in structure and is designed for performing a rapid sequence of operations without difficulty and particularly permits of swaging a tube in a plurality of passes in one heat.

This object is accomplished according to the invention in that one of the gripping heads acts as a manipulator, the mandrel is non-rotatably and axially immovably mounted in the sleeve associated with said one gripping head and has a free end which is movable into the sleeve associated with the other gripping head, which serves as a holder-up, only annular gripping surfaces, which are preferably conically tapered toward the workpiece, serve for gripping a workpiece which has been applied to the mandrel, said gripping surfaces are formed by the end faces of intermediate sleeves, which bear on the sleeves associated with the gripping heads, or by the end faces of an intermediate sleeve disposed on the same side as the holder-up, and of a mandrel collar disposed on the same side as the manipulator, and the follow-up movement performed by the holder-up during the swaging operation relative to the feed movement of the manipulator is adapted to be directly or indirectly controlled in dependence on the deviation of the actual gripping force from a set value. Because no gripping jaws are provided, the gripping heads may have a simple, rugged design and the sleeves of the gripping heads serve only to hold the long mandrel or provide a passage for it. Because the mandrel is coupled to the gripping sleeve of the manipulator, the required movement is automatically imparted to the mandrel during the swaging operation and causes the workpiece to be advanced and also to be rotated. The displacement performed by the mandrel as the same is inserted into and removed from the workpiece is also effected in unison with the gripping head because the inherently provided strong drive means for moving the gripping head are then available also for withdrawing the finished workpiece from the mandrel, which operation requires strong forces. An excellent swaging of the large workpiece is enabled in that the workpiece is gripped between the manipulator and the holder-up and the gripping force which depends on the movement performed by the holder-up in dependence on the advance and on the flow of material can be exactly adjusted. Another decisive feature resides in that the workpiece and the gripping surfaces are in contact only in a small area so that heat cannot be dissipated from the workpiece to the gripping head in a large area and a substantial cooling of the end portion of the workpiece is thus effectively precluded. As a result, a plurality of swaging passes can be performed in one heat so that a single gripping of the blank is sufficient for the manufacture of the finished tubes without reheating. When it is desired to swage a large tube, the gripping heads are moved apart until the space between the holder-up and the mandrel, which is carried along by the manipulator, is sufficient for receiving the workpiece. The workpiece is then held in front of the free end of the mandrel by means of a hoist or the like and the manipulator is thereafter displaced to move the mandrel through the workpiece and into the holder-up until the gripping surfaces hold the workpiece in position between them. The conical gripping surfaces also ensure that the workpiece is centered relative to the mandrel. Depending on the number of passes which are required, controlled displacements are imparted to the manipulator and holder-up to move the workpiece through the swaging box once or several times so that the workpiece is swaged to transform the blank into the finished tube. When it is desired to remove the workpiece, the manipulator is simply retracted to withdraw the mandrel from the workpiece while the latter is properly axially supported so that the workpiece can be removed with the aid of the hoist. It is apparent that the swaging machine has a simple, rugged design and yet enables a fast, economic swaging operation.

In a particularly desirable embodiment of the invention, the sleeves associated with the gripping heads are axially supported in the respective gripping heads through the intermediary of a spring, the excursion of the spring under the gripping force is sensed by a suitable displacement sensor or the like, and the movement of the holder-up is controlled in dependence on said excursion. Because heavy gripping heads are required to swage large tubes, certain irregularities in the displacement of the gripping heads cannot be precluded. In order to take up and compensate for these irregularities as well as irregularities of the flow of material of the workpiece being swaged, these springs are provided between the gripping heads and the sleeves associated therewith and the spring excursion under load is used as a variable for the control of the movement of the holder-up.

When the two gripping heads are hydraulically displaceable in the usual manner, a simple closed-loop control system for controlling the movement of the holder-up will be obtained in accordance with the invention if the rate at which hydraulic fluid is supplied to the hydraulic actuator for the holder-up is controlled by a variable-displacement pump, which is controlled in response to the difference between a set value of the gripping force, and an actual valve indicated by the displacement sensor.

The mode of operation of the swaging machine according to the invention can be further improved in that a stripping fork which has prongs spaced apart in accordance with the cross-section of the tube and which can be lifted and lowered is provided on the machine bed of the manipulator on the same side as the swaging box, and the mandrel collar and/or the intermediate sleeve is preferably provided adjacent to the gripping surface with flats, which fit the fork. In its upper position, that stripping fork provides a suitable support for the finished workpiece so that the latter is automatically withdrawn from the mandrel as the manipulator is retracted. Because the stripping fork is mounted on the machine bed of the manipulator, force is transmitted in a closed cycle as the workpiece is stripped so that the strong force required for withdrawing the workpiece from the mandrel can be taken up without difficulty. As the completely swaged tube, which has a smaller wall thickness than the blank, must be engaged by the stripping force without risk of damage, the flats provided adjacent to the gripping surfaces of the manipulator ensure that the clearance between the fork prongs is approximately as large as the inside diameter of the finished tube so that there is a sufficiently large bearing surface between the tube and the fork.

To facilitate the handling of the large and very heavy workpieces and to relieve the mandrel holder, a feature of the invention resides in that backing rollers for supporting the workpiece or the mandrel are provided on both sides of the swaging box and are pivotally movable up and down. Depending on the specific operation being performed in the swaging sequence, these backing rollers may be inoperative or may engage the workpiece which is to be applied to the mandrel or has been withdrawn or may support the free end of the mandrel when the gripping heads have been moved apart to a distance in excess of the mandrel length.

An embodiment of the invention is shown diagrammatically and by way of example on the accompanying drawings, in which FIG. 1 is a longitudinal sectional view showing a gripping head which in accordance with the invention serves as a manipulator, and FIGS. 2 to 5 show different phases during the swaging of a large tube with the swaging machine according to the invention.

Figures 2, 3, 4, 5:
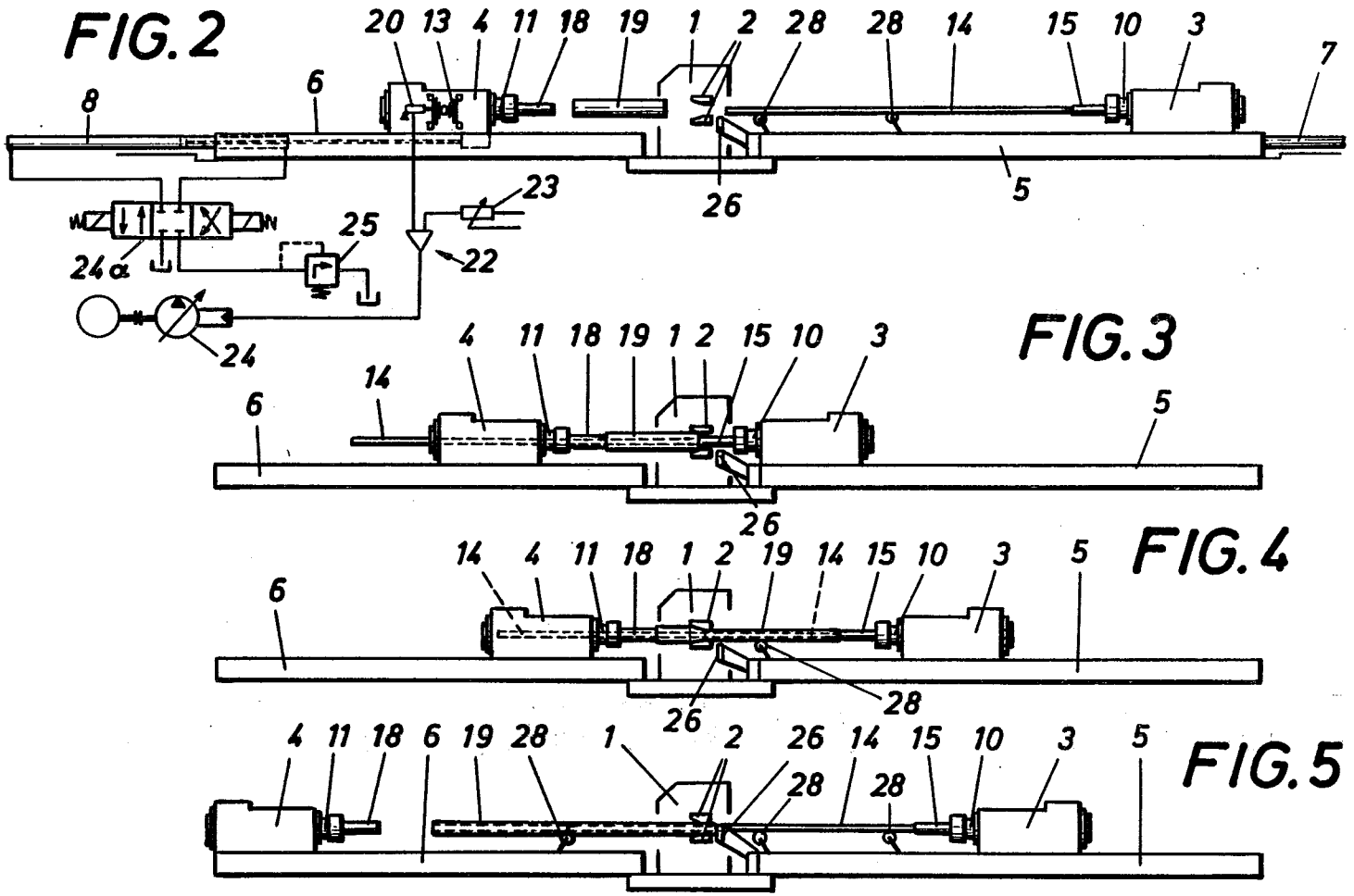

A swaging box 1 contains two dies 2, which strike radially with respect to the workpiece. Two gripping heads 3 and 4 are provided on opposite sides of the swaging box 1. These gripping heads are substantially identical in structure and each of them is guided on a separate machine bed 5 or 6 and displaceable by a hydraulic actuator 7 or 8. A sleeve 10 or 11 extends through each gripping head 3 or 4 in the workpiece-feeding direction and is adapted to be driven by a worm gearing 9. Each sleeve 10 or 11 is axially supported by the associated gripping head 3 or 4 through the intermediary of a set of leaf springs 12 or 13. A mandrel 14 is non-rotatably and axially immovably held in the sleeve 10 associated with the gripping head 3, which serves as a manipulator. The mandrel 14 is freely movable into the sleeve 11 associated with the gripping head 4, which serves as a holder-up. A collar 15 is provided on the mandrel 14 on the same side as the manipulator. The end face 16 of the collar 15 and the end face 17 of an intermediate sleeve 18, which is supported by the gripping head sleeve 11, serve as gripping surfaces for gripping a workpiece 19, which has been applied to the mandrel and is to be swaged. When the mandrel 14 has been inserted into the workpiece 19, the mandrel 14 can be moved freely through the gripping head 4 until the collar 15 engages the workpiece 19 and the latter engages the end face 17 of the intermediate sleeve 18. To ensure that that workpiece is centered relative to the mandrel 14, the end faces 16, 17 are conically tapered relative to each other. The force required to grip the workpiece 19 is exerted by means of the two gripping heads 3 and 4 and is held constant during the swaging operation. For this purpose the movement of the holder-up is constantly matched to the advance of the manipulator and to the flow of material during the swaging operation. Because the excursion of the springs 12 and 13 is an exact measure of the gripping force which is exerted, that excursion is utilized for an exact automatic control of the movement of the holder-up. As is shown in FIG. 2, a displacement sensor 20 for indicating the actual gripping force is associated with the set of leaf springs 13 (alternatively, a displacement sensor 21 could be associated with the set of leaf springs 12). In a suitable closed-loop control system 22, that actual value is compared with a set value, which is indicated by a set value signal generator 23. At a rate depending on the difference which has been ascertained by the comparison, a variable-displacement pump 24 supplies hydraulic fluid through a four-way valve **24*a* to the hydraulic actuator 8 associated with the holder-up 4. In spite of all unforeseeable influences which depend on the advance or on the flow of material, this arrangement ensures that the gripping force is always maintained constant. An overpressure relief valve 25** is provided to protect the hydraulic system.

To assist the withdrawal of the workpiece 19 from the mandrel 14, a stripping fork 26 is mounted on the machine bed 5 of the manipulator 3 on the same side as the swaging box and is adapted to be lifted and lowered. To improve the engagement of the fork with the end face of the workpiece, the collar 15 of the mandrel is provided with flats 27 adjacent to the gripping surfaces so that the prongs of the fork can be spaced so closely apart that they can engage the tube throughout its wall thickness at least in certain regions. Backing rollers 28, which are pivotally movable up and down, are provided on both sides of the swaging box 1 and serve to support the workpiece which has been withdrawn from the mandrel and as additional supports for the mandrel.

When it is desired to swage a large tube, the gripping head 3 which carries the mandrel 14 is retracted until the mandrel has left the space between the holder-up 4 and the swaging box 1 and the workpiece can be introduced into said space (FIG. 2). The manipulator 3 is then advanced to move the mandrel 14 through the workpiece 19 and the sleeve 11 associated with the holder-up 4. The latter is moved toward the workpiece at the same time so that the workpiece is gripped between the gripping surfaces 16, 17 with a suitable gripping force. In that position the two gripping heads move the workpiece to a position between the swaging dies so that the swaging operation can begin (FIG. 3). The workpiece is now swaged throughout its length while the manipulator 3 advances the workpiece and the holder-up follows up at a slightly lower speed, owing to the flow of material, and determines the gripping force exerted on the workpiece (FIG. 4). Because the workpiece is gripped by conical gripping surfaces rather than by gripping jaws, large areas of contact between the gripping head and workpiece are avoided and a rapid cooling of the workpiece at its end is thus precluded. For this reason, the workpiece can be swaged in a plurality of passes in the same heat. For that purpose the workpiece remains gripped and is returned twice or three times to its initial position and subsequently pulled again through the swaging box. The completely swaged tube is removed from the mandrel by means of the lifted stripping fork. For this purpose the gripping heads are moved apart and the mandrel is again retracted to the position in which the workpiece was inserted (FIG. 5). The tube left on the backing rollers can then be taken up by a hoist or the like and the swaging machine is then ready for swaging another tube.

The swaging machine according to the invention can be used to swage large tubes on a long mandrel in a rapid, economic process and in a single heat and with the aid of relatively simple grinding heads.

We claim:

1. A swaging machine for swaging large tubes, comprising a swaging box, a first and second gripping heads consisting of a manipulator and a holder-up, respectively and disposed on opposite sides of said swaging box, first and second gripping sleeves which are rotatably mounted in said first and second gripping heads, respectively, and aligned on a horizontal axis which extends through said swagging box, said first and second sleeves being axially coupled to said first and second gripping heads, respectively, each of said gripping heads being movable along said horizontal axis, swaging die means contained in said swaging box and operable to strike radially toward said horizontal axis, rotary drive means for rotating said first and second sleeves about said horizontal axis, a mandrel, which is non-rotatably and axially immovably mounted in said first sleeve and adapted to carry a tubular workpiece surrounding said mandrel, first and second abutments carried by said first and second gripping sleeves, respectively, and having first and second annular gripping surfaces, respectively, which surround said horizontal axis and generally face each other, said abutments being adapted to axially engage and exert a gripping force on a tubular workpiece surrounding said mandrel only with said first and second annular gripping surfaces, axial drive means for moving said first gripping head along said horizontal axis toward said swaging box and for simultaneously moving said second gripping head in the same direction, and control means for sensing the magnitude of said gripping force exerted by said abutments with said first and second annular gripping surfaces and for detecting any deviation of said magnitude from a set value and for controlling the movement of said second gripping head relative to said first gripping head along said horizontal axis in dependence on such deviation as said first and second gripping heads are simultaneously moved along said horizontal axis in said direction.

2. A swaging machine as set forth in claim 1, in which each of said annular gripping surfaces is conical and tapers toward the other of said annular gripping surfaces.

3. A swaging machine as set forth in claim 1, in which said first and second abutments consist of abutment sleeves, which surround said mandrel and are disposed between said first and second sleeves and are axially supported by said first and second sleeves, respectively.

4. A swaging machine as set forth in claim 1, in which said first abutment consists of a collar mounted on said mandrel adjacent to said first sleeve and between said first and second gripping sleeves and said second abutment consists of an abutment sleeve which surrounds said mandrel and is disposed between said first and second sleeves and is axially supported by said second sleeve.

5. A swaging machine as set forth in claim 1, in which said control means comprise a sensor for detecting said gripping force.

6. A swaging machine as set forth in claim 1, in which said first gripping head is mounted on a machine bed for movement along said horizontal axis, a stripping fork is mounted on said machine bed between said first gripping head and said swaging box and is adapted to be lifted and lowered, said stripping fork has prongs which define between them a clearance sufficient to receive a tube which has been swaged on said mandrel, and said first abutment sleeve is formed adjacent to said first gripping surface with peripheral flats which are adapted to fit between said prongs.

7. A swaging machine as set forth in claim 1, in which backing rollers which are pivotally movable up and down and adapted to support the mandrel are between each of said gripping sleeves and said swaging box.

8. A swaging machine as set forth in claim 1, in which said control means comprise a sensor for detecting a parameter which varies with said gripping force.

9. A swaging machine as set forth in claim 8, in which a spring for at least one of said sleeves is axially coupled to the associated gripping head and is arranged to exhibit an excursion in response to said gripping force and as a measure thereof, and said sensor is arranged to detect said excursion.

10. A swaging machine as set forth in claim 1, in which said axial drive means comprise a first hydraulic actuator for moving said first gripping head and a second hydraulic actuator for moving said second gripping head and said control means comprise rate control means for supplying hydraulic fluid to said second hydraulic actuator at a rate which depends on such deviation.

11. A swaging machine as set forth in claim 10, in which said rate control means comprise a variable-displacement pump.

* * * * *